US005337434A

United States Patent [19]

Erlich

[11] Patent Number: 5,337,434

[45] Date of Patent: Aug. 16, 1994

[54] DIRECTIONAL CONTROL MEANS FOR ROBOTIC SWIMMING POOL CLEANERS

[75] Inventor: Giora Erlich, North Caldwell, N.J.

[73] Assignee: Aqua Products, Inc., Cedar Grove, N.J.

[21] Appl. No.: 45,897

[22] Filed: Apr. 12, 1993

[51] Int. Cl.[5] ..... E04H 3/20

[52] U.S. Cl. ..... 15/1.7

[58] Field of Search ..... 15/1.7, 319

[56] References Cited

U.S. PATENT DOCUMENTS

| | | | |
|---|---|---|---|
| 4,154,680 | 5/1979 | Sommer | 15/1.7 |
| 4,168,557 | 9/1979 | Rasch | 15/1.7 |
| 4,304,022 | 12/1981 | Sommer | 15/1.7 |
| 4,518,437 | 5/1985 | Sommer | 15/1.7 |
| 4,700,427 | 10/1987 | Knepper | 15/319 |
| 5,001,800 | 3/1991 | Parenti et al. | 15/1.7 |
| 5,197,158 | 3/1993 | Moini | 15/1.7 |

FOREIGN PATENT DOCUMENTS

| | | | |
|---|---|---|---|
| 2584442 | 1/1987 | France | 15/1.7 |

*Primary Examiner*—Edward L. Roberts

*Attorney, Agent, or Firm*—Lawrence and Walsh

[57] ABSTRACT

Directional control means are provided for robotic swimming pool or water tank cleaner of the type having an internal filter bag for removing and retaining debris from the pool, an electric pump for drawing water through the filter bag and two parallel motor driven cylindrical brushes for propelling the cleaner along and sweeping the bottom surface of the pool, said control means including one or more water activated hydraulic cylinders located on the side of the cleaner between the brushes, each containing a leg adapted to project downwardly to contact the pool bottom and partially lift one side of the cleaner. As the cleaner moves along the pool bottom it pivots around the projected leg to change direction. Manual or automatic means can be provided to activate the hydraulic legs.

5 Claims, 1 Drawing Sheet

DIRECTIONAL CONTROL MEANS FOR ROBOTIC SWIMMING POOL CLEANERS

BACKGROUND OF THE INVENTION

This invention relates to a submersible robotic apparatus for cleaning water tanks, reservoirs, swimming pools or the like, and more particularly to means for controlling the direction of travel of the apparatus along the bottom of the tank or pool to be cleaned.

Self-contained electrically powered robotic devices for cleaning water tanks, reservoirs or more particularly, swimming pools are well known. These devices generally comprise a housing, a removable filter bag disposed within the housing for removing and retaining debris from the water, a pump for drawing water through the filter bag, and two parallel motor-driven cylindrical brushes disposed at both ends of the housing for propelling the cleaner along and sweeping the bottom surface of the pool. Tank or caterpillar type tracks usually extend between the cylindrical brushes on both sides of the housing and assist in moving the cleaner along the surface to be cleaned by providing increased traction. The pump which draws the water through the filter bag provides a downward thrust to maintain the cleaner in contact with the internal surface of the pool being cleaned. Solid State timers, switches and microprocessors are provided to reverse the direction of the drive motors at predetermined or preprogrammed time intervals and to automatically stop the device after it has completed a pretimed cleaning cycle.

Unfortunately, merely reversing a drive motor causes the cleaning device to move forward and backward along the same path and thus does not effectively cover the entire surface to be cleaned. This deficiency is overcome in those pool cleaners which are adapted to climb the walls of the pool by means of a floatation device which provides an upward bias at an angle to the direction of movement of the cleaner, thus causing the pool cleaner to veer off in a slightly different direction as it climbs the wall of the pool. When the drive motor is then reversed, the pool cleaner traverses a path which differs from the path previously traveled. In this manner, over a period of time, a substantial portion of the bottom and the walls are covered by the cleaner.

In large public swimming pools and industrial water tanks or reservoirs it is often impractical for the cleaning device to be adapted to climb the walls due to the time constraints involved in cleaning large bottom surface areas or the steepness or irregularity of the walls. Thus, a problem arose in developing means for directing the path of travel of cleaners whose direction could not be controlled by a biased float means. To solve this problem various complex devices were developed to steer the cleaning apparatus to travel along preprogrammed paths. Such devices include multiple wheels which are individually motor-driven and which are activated and deactivated according to the program and complex clutch devices connected to a single motor and adapted to engage and disengage various drive wheels according to the program. These devices also include either mechanical or electronic sensing devices, such as ultrasound, laser or infrared, which are adapted to reverse the drive motors and when the device comes in contact with, or nears, the walls of a pool or tank or other obstacle. Unfortunately, devices of this type are expensive and unduly complex and because of such complexity are often unreliable.

BRIEF SUMMARY OF THE INVENTION

According to the present invention, means for controlling the direction of travel of a robotic cleaning device along an interior surface of a swimming pool or tank is provided which simply and efficiently overcomes the difficulties and complexities of the prior art.

In general, the invention comprises directional control means for a submergible robotic swimming pool cleaner of the type having an internal filter bag for removing and retaining debris from the pool, a pump for drawing water through the filter bag, and two parallel motor-driven cylindrical brushes for propelling the cleaner along and sweeping the bottom surface of the pool, the control means including one or more water actuated hydraulic legs located on the sides of the cleaner between the brushes and adapted to project downwardly on command to contact the pool bottom and partially lift a portion of the cleaner, thereby causing the cleaner, as it moves along the pool bottom, to pivot around the projected leg to change direction.

Complicated steering and and clutch mechanisms are eliminated and the cylindrical brushes can be simply driven by a single reversible motor which is controlled by a microprocessor to cycle in forward and reverse directions at preprogrammed time intervals. The microprocessor can also be programmed to activate the hydraulic legs at predetermined or random time intervals to cause a directional change in both the forward or reverse direction modes of operation. It will be appreciated that the longer the duration of time that the hydraulic leg is projected, the greater the amount of turning and directional change. Thus, by programming the sequence and time duration of the forward and reverse movement of the drive motor and the sequencing, the length of time and time interval between the actuation of the hydraulic legs, the pattern movement of the swimming pool cleaner along the bottom of the pool can be effectively controlled so that substantially all of the bottom surface area is cleaned with a minimum travel path and in a systematic fashion.

The robotic cleaning device can also be provided with electronic means or a mechanical probe to sense or detect a wall or other obstruction which will thereupon send a command signal to the microprocessor to reverse the drive motor and to project one of the hydraulic legs to cause a change in direction of the cleaner to avoid the obstacle or the wall. The sensing means can utilize an electro-mechanical switch or well known infrared, laser or ultrasound technology to detect an obstruction. The electro-mechanical switch can simply comprise a plunger type switch which is activated upon contact with a wall or obstruction. Manual switching means actuated from outside the pool can also be provided so that an operator can simply press a button to reverse the drive motor and/or cause the actuation of the hydraulic legs.

In the preferred embodiment, the hydraulic leg comprises a piston with a downwardly-extending piston rod disposed in a water-actuated cylinder. A reversible submersible pump disposed within the body of the swimming pool cleaner is connected by flexible tubing to each of the cylinders. A pair of such cylinders are preferably mounted on opposite sides of the cleaner between the two cleaning brushes. The pump is driven by a reversible low-power electric motor and contains a single inlet and a separate outlet for each of the cylinders. Operation of the pump in one direction applies pressure to one of the cylinders to cause the hydraulic leg to be projected downwardly. Operation of the pump in the opposite direction activates the other hydraulic leg. A spring disposed within the cylinder returns the leg to its non-projected position when the pump is deactivated.

The use of a submergible pump and a hydraulic cylinder is efficient, inexpensive and far more reliable than complex, individual motor-driven wheels or clutch arrangements utilized in the prior art for steering a pool cleaning device. Since the submergible pump and the hydraulic leg utilizes the water in the pool or tank, they create no leakage problem. Moreover, a relatively small pump can be utilized to create sufficient hydraulic force to project the leg and lift the cleaning device. It should be noted that to further enhance the efficiency of the hydraulic leg, the pump for drawing water through the filter which provides a downward force on the pool bottom can be deactivated simultaneously with the activation of the hydraulic leg. This eliminates the downward force on the pool bottom created by the pump and reduces the pressure required to lift the cleaner from the bottom.

The directional control means of the invention can also be utilized on swimming pool cleaners of the type described herein which are adapted to climb the walls of a pool so that a single design can be utilized for non-climbing and climbing applications. To accomplish this, the wall sensing devices, whether mechanical or electronic, can be deactivated manually for wall climbing applications.

BRIEF DESCRIPTION OF THE DRAWINGS

Preferred embodiments of the inventions have been chosen for purposes of illustration and description and are shown in the accompanying drawings wherein.

DETAILED DESCRIPTION OF PREFERRED EMBODIMENTS

Figure 1:
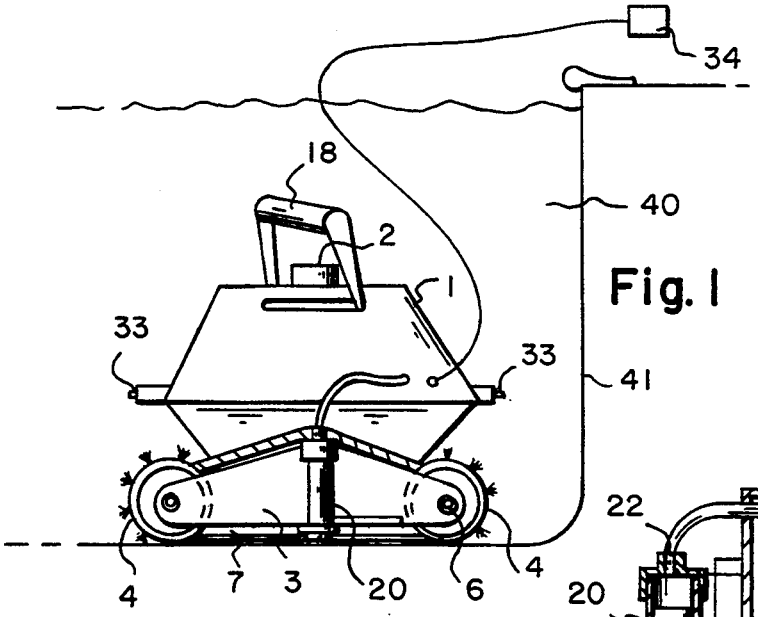
FIG. 1 is a side view of a robotic swimming pool cleaner incorporating the directional control means of the invention.
Figure 2:
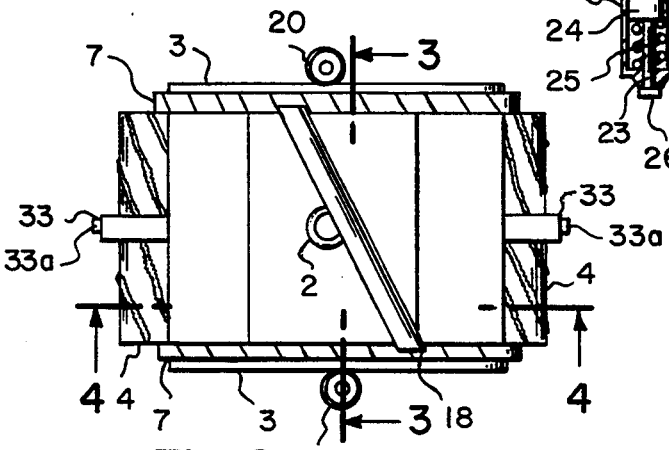
FIG. 2 is a top view of the swimming pool cleaner shown in FIG. 1.
Figure 4:
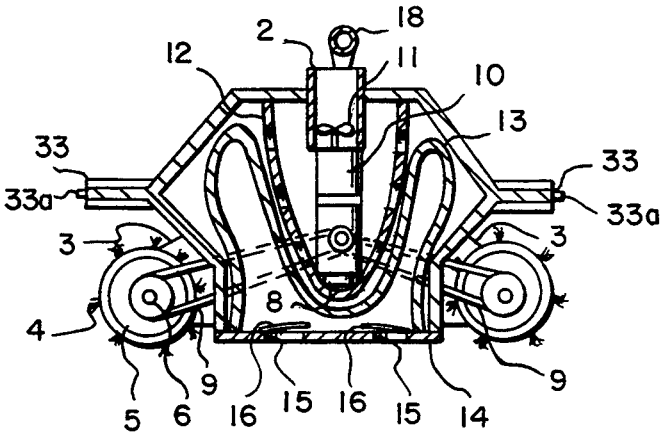
FIG. 4 is a cross-sectional view taken generally along the line 4—4 of FIG. 2.

The robotic cleaning apparatus illustrated in the drawings is shown in a swimming pool 40 and includes a hollow body 1 having an open rectangular bottom and a cylindrical outlet 2 located at the top. A pair of mounting brackets 3 best seen in FIG. 1 are attached to opposite sides of housing 1. Cleaning and drive brushes 4 mounted on rotatable drums 5, best seen in FIG. 4 extend between the ends of the mounting brackets 3 at both ends of the body 1 and are connected to the mounting brackets 3 by suitable axles 6. A flexible rubber tank or caterpillar type track 7 extends between and connects the rollers 5 on both sides of the housing. A reversible electric drive motor 8 shown in FIG. 4 is disposed within housing 1 and is connected by two drive belts 9, also shown in FIG. 4, to drums 5 to selectively impart forward or reverse rotational movement thereto. A second electric motor 10 also disposed within body 1 is connected to an axial flow pump impeller 11 disposed within the cylindrical outlet 2 at the top of housing 1 to draw water from the pool into the housing and discharge same through outlet 2.

Figure 5:
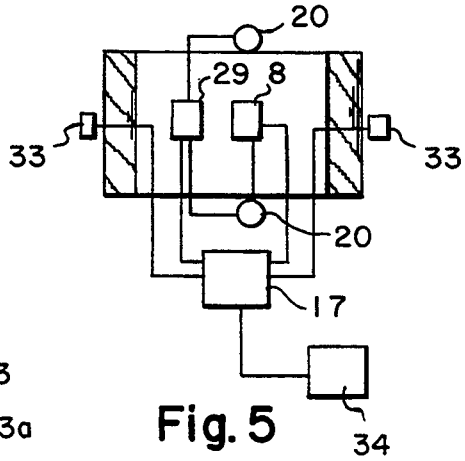
FIG. 5 is a schematic block diagram of the direction control means of the invention.

A perforated internal housing 12 contains the drive motor 8 and the pump motor 10 within the interior of body 1. A removable filter bag detachably connected at its open end to a rectangular closure plate 14 is disposed within housing 1 externally of secondary housing 12. The bottom plate 14 has at least two inlets 15 covered by rubber flaps 16 which serve as check valves to permit flow into the filter bag, but prevent the discharge of dirty water back into the pool when the impeller pump is stopped. An electronic microprocessor 17 shown in the schematic of FIG. 5 is also disposed within the secondary housing 12 and encased together with motors 8 and 10 in a waterproof compartment (not shown).

A handle 18 formed of flotation material is pivotally mounted to the top of body 1 and disposed at an angle to the normal direction of movement.

Figure 3:
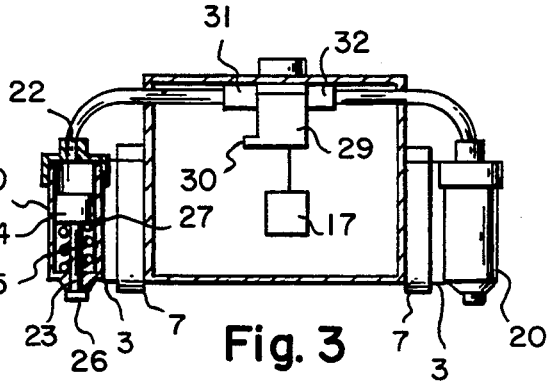
FIG. 3 is a view partly in cross-section and partly in elevation taken generally along line 3—3 of FIG. 2 with portions removed for clarity.

Mounted on the outside of brackets 3 on both sides of the pool cleaner body 1 are hydraulic cylinders 20. As shown in FIG. 3 the cylinders 20 comprise a housing 21 having an outlet 22 located at the top and an opening 23 located at the bottom. A piston 24 is slideably disposed within the housing 21 for reciprocal movement in a downwardly and upwardly direction. A piston rod or leg 25 is axially connected to the bottom of piston 24 and extends through opening 23 of housing 21. A rubber or plastic nipple 26 is attached to the bottom end of leg 25 to prevent the leg from damaging a pool made of vinyl material. Spring 27 is disposed around leg 25 within housing 21 and serves to bias the piston 24 in an upward direction so that only nipple 26 extends below the housing 21 when no pressure is applied to cylinder 20. A flexible tube 28 connects the outlet 22 of housing 21 to an electrically driven pump 29 connected to microprocessors 17. The pump 29 has a single inlet 30 and two outlets 31 and 32 which are connected to the cylinders 20 by means of flexible tubing 28. Pump 29 is of the reversible type capable of drawing water into inlet 30 and applying hydraulic water pressure to either one of the two cylinders 20 via outlets 31 or 32. Reversing the pump 20 causes the pressure to be applied to the opposite cylinder.

A pair of elongated wall-sensing probes 33 are mounted on opposite ends of the body 1. The sensing probes include electro-mechanical switches 33*a* actuated upon contact with the wall 41 of the pool or other obstacle. The wall sensing device 33 is connected to and delivers an electrical signal to microprocessor 17. The microprocessor 17 is electrically connected to an external power and switching source 34 outside of the pool.

In operation, activating the power source 34 allows current to flow to the microprocessor 17, which activates drive motor 8 and pump motor 10. A driving force is thereupon applied to the cylindrical brushes 4 by means of the drive belts 9 and due to the traction of the brushes 4 on the bottom of the pool as well as the traction created by the tank track 7 on the bottom the pool, the pool cleaner begins its travel. Simultaneously, the impeller 11 controlled by the pump motor 10 draws water through the inlets 15 at the bottom of plate 14 and through the filter bag 13 which retains debris and dirt particles within its interior. Water then flows through the perforations of internal housing 12 and is thrust outwardly via outlet 2 of body 1. The pressure of the flow created by the impeller 2 not only draws the water through the filter bag 13, but provides a downward thrust to hold the cleaner firmly against the bottom of the pool. When the impeller is stopped, the rubber flaps 16 prevent the dirty water contained within the filter bag 13 from discharging into the pool.

The device illustrated is capable of climbing the walls of a pool if so desired simply by deactivating the wall sensing devices 33. When the cleaner reaches a wall, it tends, due to the friction of the brushes 4 on the surface to climb up upon the wall. The thrust emitted by impeller 11 holds the cleaner against the wall and the float handle 18 provides buoyancy to lift it as it travels upward on a wall. By disposing the float handle 18 at an angle to the direction of movement of the cleaner, the cleaner tends to veer off its former track and take a slightly different course as it climbs the wall. At a preprogrammed time interval the microprocessor 17 reverses the drive motor 8 and the cleaner descends again into the pool on a different course than previously travelled.

In addition, and in accordance with the improvement of this invention, each time the microprocessor signals a reversal of drive motor 8, power is applied to pump 29 to apply pressure to one or the other of the cylinders 20 causing leg 25 to be hydraulically activated. As the leg is projected downwardly, one side of the cleaning device is lifted from the bottom or wall of the pool and as the drive force is continually applied to the brushes 4 and track 7, the cleaner pivots around the projected hydraulic leg causing the unit to change course. The duration of time that the leg 25 is projected determines the degree to which the unit will turn, and such amounts can be preprogrammed into microprocessor 17. Similarly, the microprocessor 17 is programmed to control pump 29 to systematically activate one or the other of the cylinders 20 to cause the cleaning unit to turn to the right or the left depending on the pattern of cleaning desired.

If it is desired that the pool cleaner not climb the walls of the pool, the wall sensing units 33 can be activated. In such instance as a sensing unit 33 comes into contact with a wall it emits a signal to the microprocessor 17 which causes drive motor 8 to reverse and one or the other of the cylinders 20 to be activated to cause a change in direction of movement, thus ensuring that the entire pool bottom is cleaned. To assist the hydraulic cylinders 20 in lifting one side or the other of the pool cleaner from the bottom, the microprocessor 17 can also be programmed to shut off motor 10 when pump 29 is activated. This will stop the thrust caused by the impeller 11, thus requiring less effort by hydraulic cylinder 20 the lift the pool cleaner.

The power source 34 also contains a control unit to manually change the direction of the cleaner by reversing drive motor 8 and activating one or the other of the hydraulic cylinders 20. Similarly, the wall sensing devices 33 can be actuated manually or deactuated. The circuitry and programming necessary to accomplish these control functions are well known in the art.

What is claimed is:

1. Directional control means for an automatic swimming pool cleaner of the type having a housing, with front and rear ends and two sides, a pair of motor driven cylindrical brushes rotatably mounted on the front and rear ends of the housing respectively for propelling the cleaner along the bottom surface of a swimming pool, said control means comprising a projectable leg mounted on one side of the housing between the front and rear ends; and means to reciprocably operate the leg for projected movement into contact with the bottom surface of the swimming pool to partially lift one side of the cleaner from said surface as it is propelled therealong causing the cleaner to pivot around the projected leg to change direction.

2. The directional control means of claim 1, wherein the means to reciprocably operate the leg comprises a hydraulic cylinder.

3. The directional control means of claim 1, wherein the means to reciprocably operate the leg comprises an electric water pump to provide hydraulic pressure; a cylinder connected to the water pump; a piston disposed within the cylinder for reciprocal motion; and said leg connected to the piston to project downwardly from the cylinder into contact with the bottom surface of the pool upon application of hydraulic pressure to the cylinder.

4. The directional control means of claim 1, in which the projectible leg is disposed on one side of the housing, and a second projectible leg is disposed on the opposite side of the cleaner.

5. The directional control means of claim 1, further comprising means to reverse the motor driven cylindrical brushes; a probe disposed on the cleaner to detect an obstacle in it path; and switching means disposed on the end of the probe to emit a signal to reverse the drive motor and actuate the means to reciprocably operate the leg upon contact of the probe with an obstacle.

* * * * *